US007530886B2

(12) United States Patent
Smarsh

(10) Patent No.: US 7,530,886 B2
(45) Date of Patent: May 12, 2009

(54) NON-GLAZING DRESSING WHEEL

(76) Inventor: Steven G. Smarsh, 32365 N. River Rd., Harrison Twp, MI (US) 48045

( * ) Notice: Subject to any disclaimer, the term of this patent is extended or adjusted under 35 U.S.C. 154(b) by 0 days.

(21) Appl. No.: 10/560,521

(22) PCT Filed: Jun. 23, 2004

(86) PCT No.: PCT/US2004/020016

§ 371 (c)(1),
(2), (4) Date: Dec. 13, 2005

(87) PCT Pub. No.: WO2005/000523

PCT Pub. Date: Jan. 6, 2005

(65) Prior Publication Data

US 2006/0286911 A1 Dec. 21, 2006

Related U.S. Application Data

(60) Provisional application No. 60/480,977, filed on Jun. 23, 2003.

(51) Int. Cl.
*B24B 21/18* (2006.01)

(52) U.S. Cl. ..... 451/444; 451/49; 451/56; 451/443; 451/540

(58) Field of Classification Search ..... 451/49, 451/56, 443, 444, 540
See application file for complete search history.

(56) References Cited

U.S. PATENT DOCUMENTS

| | | | | |
|---|---|---|---|---|
| 3,602,209 | A * | 8/1971 | Bocker | 125/11.03 |
| 5,289,815 | A * | 3/1994 | Krenzer | 125/11.03 |
| 6,123,605 | A | 9/2000 | Yano | |
| 6,338,672 | B1 | 1/2002 | White | |
| 6,932,076 | B2 * | 8/2005 | Liao et al. | 125/15 |

* cited by examiner

*Primary Examiner*—Joseph J Hail, III
*Assistant Examiner*—Shantese McDonald
(74) *Attorney, Agent, or Firm*—Cargill & Associates, PLLC; Lynn E. Cargill, Esq.

(57) ABSTRACT

A non-glazing dressing wheel (10) suitable for dressing a grinding wheel surface to be used for maintaining a certain tolerance to assure reliability and quality control of ground parts during the grinding operation. The dressing wheel includes at least a first dressing wheel component (12) including at least one interrupted cutting outer surface, wherein the interrupted cutting surface is embodied in a cutting wheel (10) with a plurality of tips (12) extending outwardly from the outer surface. The plurality of tips (12) contact the grinding wheel during the grinding operation, thereby alleviating glazing and heat expansion of the grinding wheel while being dressed. Other preferred embodiments include sandwiching the interrupted cutting surface between two flat grinding surfaces, preferably being made of diamond or Borazon.

19 Claims, 2 Drawing Sheets

NON-GLAZING DRESSING WHEEL

CROSS REFERENCES TO RELATED APPLICATIONS

This application claims the benefit of U.S. Provisional Application No. 60/480,977 filed on Jun. 23, 2003.

BACKGROUND OF THE INVENTION

1. Field of the Invention

The present invention relates to dressing wheels, methods of manufacturing same, and methods of using same. More particularly, the invention relates to a non-glazing dressing wheel for high tolerance grinding operations.

2. Description of the Prior Art

In the centerless grinding industry, dressing wheels are conventionally used in order to true up the grinding wheel between jobs in order to maintain a high tolerance of accuracy in the grinding operations. In the course of using the dressing wheel to true up the grinding wheel, the dressing wheel can glaze the surface of the grinding wheel or it may cause heat expansion on the surface of the grinding wheel, and can destroy the effectiveness of the grinding wheel on later jobs. Other problems may also occur besides those mentioned. When heat expansion occurs, the grinding wheel may expand out of proper tolerance dimensions, and is therefore incapable of accurately performing the grinding operation in the manner which is desired. As grinding operations become more and more precise, the dressing wheel becomes increasingly important to keep the grinding wheel in near perfection so that the subsequent work pieces are as close as possible to perfection.

Although the invention will be described by way of examples hereinbelow for specific embodiments having certain features, it must also be realized that minor modifications that do not require undo experimentation on the part of the practitioner are covered within the scope and breadth of this invention. Additional advantages and other novel features of the present invention will be set forth in the description that follows and in particular will be apparent to those skilled in the art upon examination or may be learned within the practice of the invention. Therefore, the invention is capable of many other different embodiments and its details are capable of modifications of various aspects which will be obvious to those of ordinary skill in the art all without departing from the spirit of the present invention. Accordingly, the rest of the description will be regarded as illustrative rather than restrictive.

It would be of a great advantage to the grinding wheel industry if there was provided a non-glazing dressing wheel and method of making it.

SUMMARY OF THE INVENTION

In accordance with the above-noted advantages and desires of the industry, the present invention provides a non-glazing dressing wheel, a method of making same, and a method of using it for very high tolerance grinding operations, such as for medical applications. In the most basic embodiment, an interrupted cutting surface is used within a dressing wheel to overcome some of the aforementioned problems with the prior art because interrupted cutting of the grinding wheel alleviates or eliminates glazing and/or heat expansion of the grinding wheel being dressed.

One specific preferred embodiment has certain features including a star-shaped stainless steel cutting star sandwiched between two dressing stones and adhered therein. This preferably includes the use of two grinding stones sandwiching a saw-toothed metallic portion to provide interrupted cutting of a dressing wheel incorporating the present invention. The star-shaped cutting star will be of an even diameter with the rest of the dressing wheel, or it may even be slightly smaller in diameter. Furthermore, the cutting star may be made of nearly any material throughout the bulk of the star, so long as the tips of the cutting star are hardened, or made of attached hardened tip portions, to effect interrupted cutting. Another preferred embodiment has other features including a double sandwich configuration, with the utilization of three separate dressing stones having two cutting stars adhered therewithin.

Generally, the preferred embodiment is embodied in a dressing wheel suitable for dressing a grinding wheel surface to be used for maintaining a certain tolerance to assure reliability and quality control of ground parts during the grinding operation. The dressing wheel includes at least a first dressing wheel component including at least one interrupted cutting outer surface, wherein the interrupted cutting surface is embodied in a cutting wheel with a plurality of tips extending outwardly from the outer surface. The plurality of tips contacts the grinding wheel during the grinding operation, thereby alleviating glazing and heat expansion of the grinding wheel while being dressed.

The preferred embodiment also includes at least one additional dressing wheel component with at least one flat grinding surface adjacent to the interrupted cutting outer surface, so that the interrupted cutting surface is adjacent to the flat grinding surface. As the dressing operation goes across the surface of the grinding wheel, the interrupted cutting surface acts to remove any glazing or heat expansion caused by the flat grinding surface. Most preferably, though, at least two additional dressing wheel components are included with flat grinding surfaces adjacent to, and surrounding, the interrupted cutting outer surface. This results in a "sandwich" configuration with two flat grinding wheels on either side of a cutting wheel with interrupted cutting surfaces. The sandwich is dragged across the surface of the grinding wheel in order to dress it, and the flat portions dress the grinding wheel, while the interrupted cutting surfaces remove any glazing, while it alleviates heat expansion.

The invention is particularly useful for applications of high tolerance grinding operations, where maintaining a very high tolerance is mandatory. In these operations, the grinding wheel is generally dressed after each and every grinding so as to maintain the tolerances needed for the job.

Although the invention will be described by way of examples hereinbelow for specific embodiments having certain features, it must also be realized that minor modifications that do not require undo experimentation on the part of the practitioner are covered within the scope and breadth of this invention. Additional advantages and other novel features of the present invention will be set forth in the description that follows and, in particular, will be apparent to those skilled in the art upon examination or may be learned within the practice of the invention. Therefore, the invention is capable of many other different embodiments and its details are capable of modifications of various aspects which will be obvious to those of ordinary skill in the art, all without departing from the spirit of the present invention. Accordingly, the rest of the description will be regarded as illustrative rather than restrictive.

BRIEF DESCRIPTION OF THE DRAWINGS

For a further understanding of the nature and advantages of the expected scope and various embodiments of the present invention, reference shall be made to the following detailed description, and when taken in conjunction with the accompanying drawings, in which like parts are given the same reference numerals, and wherein.

DETAILED DESCRIPTION OF THE INVENTION

Figure 1A:
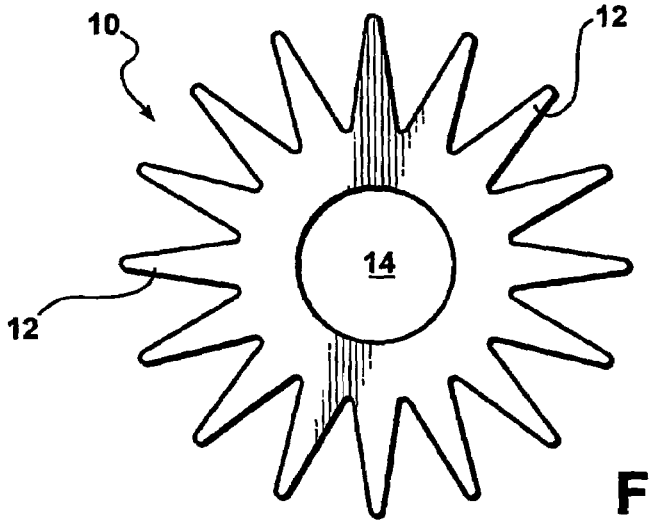
FIG. 1A is a top plan view of a first component of a dressing wheel made in accordance with the present invention.

The present invention achieves the above described advantages and objectives because it involves a new configuration of a dressing wheel, made in accordance with the present invention, which involves interrupted cutting of the grinding wheel, thereby alleviating or eliminating glazing and/or heat expansion of the grinding wheel being dressed. In addition to a singular interrupted cutting surface dressing wheel, the dressing wheel may also be made of a single or multiple sandwich concept, in which at least one material having a dressing wheel characteristic is utilized for the outer components of the sandwiched dressing wheel, as described more fully hereinbelow.

The present invention provides a non-glazing and non-heat expanding dressing wheel for dressing grinding wheels that is especially useful in centerless grinding and other applications. In the preferred embodiment, a surface having an interrupted cutting surface is disclosed which includes a star-shaped stainless steel cutting star which is sandwiched between two dressing wheel materials. The star may be made of stainless steel of any grade, cold rolled steel, copper, brass, or any other suitable metal. In addition, there may be more than one of the star-shaped dressing wheel components, but multiple star-shaped components may be utilized and sandwiched between various ceramic dressing wheel materials, or may be sandwiched next to each other in the middle of the dressing wheel. The star-shaped non-glazing dressing stone component also generally will include a central orifice for attachment to a spindle on the center less grinding machine.

Generally, the extent of the star-shaped or saw-blade-shaped dressing wheel component for interrupted cutting will be of an even diameter with the rest of the dressing wheel ceramic components, or may be slightly smaller in diameter in order to prevent ripping of the grinding wheel, rather than just interrupted cutting of the grinding wheel. Although it is reasoned that the interrupted cut component of the dressing wheel should be even with or smaller than the diameter of the dressing wheel, it is possible that for certain applications, the star-shaped component should be of a slightly greater diameter than the borazon, diamond, or ceramic dressing wheel component.

In addition, and in another embodiment, various other star-shaped components may also be made like a circular saw blade. This embodiment may include hardened tips, such that the bulk of the saw blade component may be made of almost any material, as long as the tips are hardened to effect interrupted cutting, thereby preventing glazing and or heat expansion of the grinding wheel be dressed. Tips of ceramic materials described herein with regard to the dressing stones may also be attached to a steel star. Further, the star-shaped component or the saw-blade component may also be made itself of a sandwiched material as would be known in the metallurgical art, and may be incorporated into the present invention without undo experimentation. The saw-blade configuration may also take the shape of the saw-blade configuration of FIG. 18 of U.S. patent application Ser. No. 09/720,576, filing date of Dec. 22, 2000, which is incorporated herein by reference.

Looking now to the drawings, we first look at FIG. 1A, where a star-shaped dressing wheel component has been taken out of the dressing wheel of the present invention, and is generally shown and referred to by numeral 10. Star-shaped component 10 includes star tips 12, and has a central orifice 14 therethrough in order to allow for mounting onto a spindle assembly which is utilized to rotate the dressing wheel. The remaining components are shown in subsequent drawings.

Figure 1B:
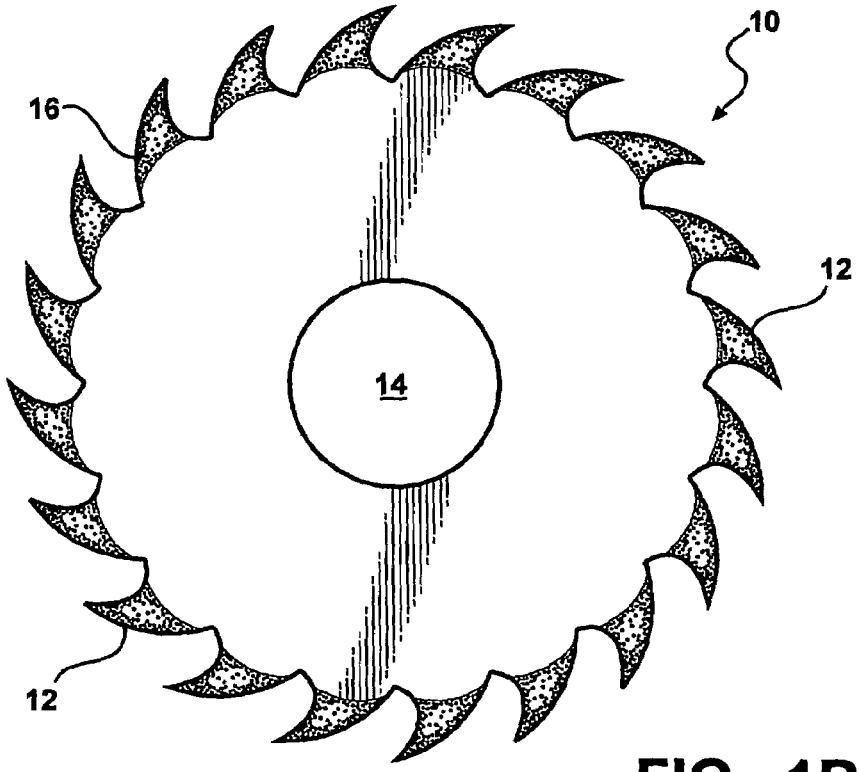
FIG. 1B is a top plan view of another embodiment.

FIG. 1B illustrates another embodiment of the interrupting cut portion of the present invention, i.e. one that looks like the saw blade of a circular saw, and is also generally denoted by numeral 10. The interrupted cutting surfaces, or star tips 12, are shown having hardened tips 16. Again, central orifice 14 extends therethrough for mounting on a spindle assembly, while the bulk of the star-shaped component 10 may be made of any suitable material, so long as the tips are hardened as shown as tips 16. Again, hard or super hard tips may be attached to the wheel component. As discussed hereinabove, different configurations of the materials and interrupted cutting surfaces of the star-shaped component 10 may be utilized, without undo experimentation, so long as it achieves the objectives of the present invention, i.e. to prevent or alleviate glazing and/or heat expansion of a wheel being dressed. The great number of possibilities of the configurations of the tips for the star-shaped component 10 are too numerous to list here, or to even show here, but all of them may be utilized, and are within the scope of the present invention. Again, so long as interrupted cutting is effected by the dressing wheel, the star-shaped component 10 will have achieved its purpose.

Figure 2A:
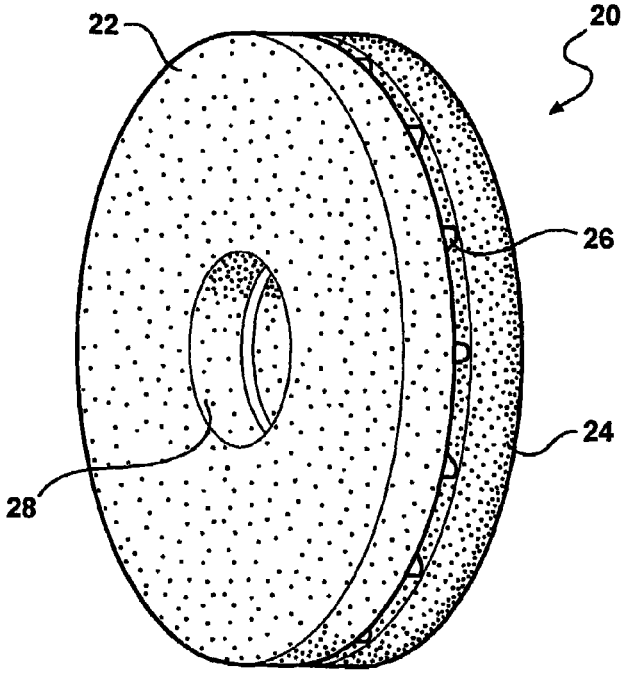
FIG. 2A illustrates and details a perspective view of a sandwiched configuration.

FIG. 2A illustrates the preferred embodiment of the present invention, including a multi-layer sandwiched dressing wheel generally denoted by the numeral 20. Within multi-layer dressing wheel 20, there is a first dressing wheel component 22 and a second dressing wheel component 24 located on either side of the star-shaped component (only the tips are shown), but showing the star-shaped tips 26 extending to the outer diameter of both of the first and second dressing wheel components 22 and 24, respectively. Although the first and second dressing wheel components 22 and 24 may be made of any suitable material, such as diamond, or borazon, the present invention envisions the use of any suitable hard material including any suitable ceramic, including silicon carbide, silicon nitride, silicon oxynitride, silicon carbonitride, boron carbide, tungsten carbide, titanium carbide, or combinations of those ceramics, or any other suitable ceramic, including aluminum oxide, aluminum nitride, aluminum carbide, or any of the other super hard ceramics. In the present invention, the preferred embodiment includes the use of a silicon carbide material for the first dressing wheel component, while aluminum oxide is used for the second dressing wheel component.

Figure 2B:
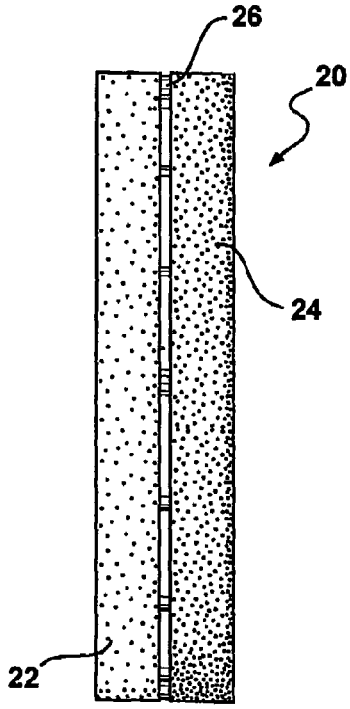
FIG. 2B is the side elevational view of the sandwich of FIG. 2A.

FIG. 2B is a side elevational view of the dressing wheel sandwich 20 in accordance with the present invention, illustrating the relative placement of the first dressing wheel component 22 and the second dressing wheel component 24, with sandwiching the star-shaped interrupted cutting component 26. Star-shaped component 26 extends to the diameter of the other dressing wheel components 22 and 24, and may be of the same diameter, a smaller diameter, or a slightly larger diameter.

Figure 2C:
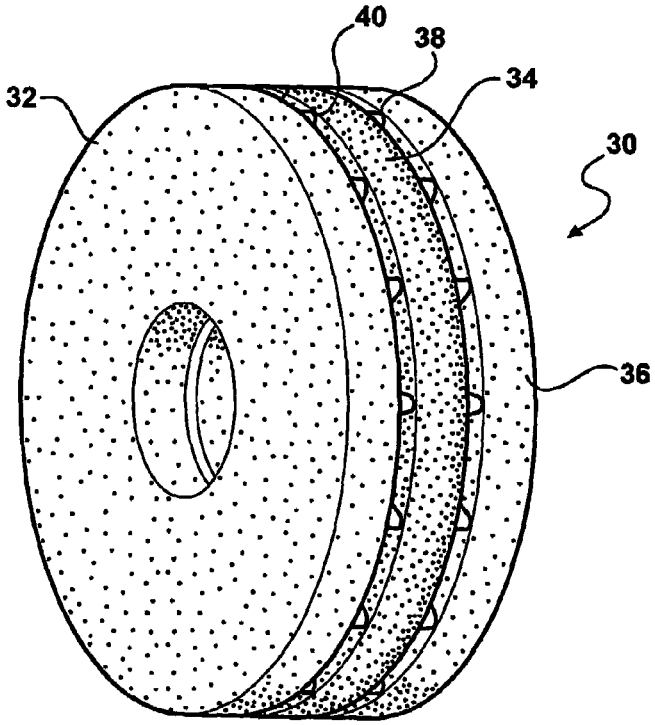
FIG. 2C is a perspective view of another embodiment of the present invention.

FIG. 2C illustrates yet another embodiment including a multi-layer dressing wheel 30 having more than one star-shaped component sandwiched therein. Multi-layer dressing wheel 30 will include at least a first dressing wheel component 32, a second dressing wheel component 34, and a third dressing wheel component 36. Sandwiched therebetween will be a first star-shaped component 38, and a second star-shaped component 40.

In summary, numerous benefits have been described which result from employing any or all of the concepts and the features of the various specific embodiments of the present invention, or those that are within the scope of the invention. The non-glazing dressing wheel performs well for high tolerance grinding operations.

The foregoing description of a preferred embodiment of the invention has been presented for purposes of illustration and description. It is not intended to be to be exhaustive or to limit the invention to the precise form disclosed. Obvious modifications or variations are possible in light of the above teachings with regards to the specific embodiments. The embodiment was chosen and described in order to best illustrate the principles of the invention and its practical applications to thereby enable one of ordinary skill in the art to best utilize the invention in various embodiments and with various modifications as are suited to the particular use contemplated. It is intended that the scope of the invention be defined by the claims which are appended hereto.

INDUSTRIAL APPLICABILITY

The present invention finds particular utility in the grinding industry, especially in the industry of high tolerance grinding of medical components and other high tolerance grinding applications.

What is claimed is:

1. A dressing wheel suitable for dressing a grinding wheel surface to be used for maintaining a certain tolerance to assure reliability and quality control of ground parts during the grinding operation, comprising:

a dressing wheel component selecting from the group consisting of star-shaped, saw-blade-shaped and circular saw-shaped dressing wheel components, including at least one interrupted cutting outer surface, wherein the interrupted cutting surface is embodied in a cutting wheel with a plurality of tips extending outwardly from the outer surface, wherein said plurality of tips contacts the grinding wheel during the grinding operation, thereby alleviating glazing and heat expansion of the grinding wheel while being dressed, wherein the interrupted cutting surface dressing wheel components includes multiple star-shaped components sandwiched between ceramic dressing wheel materials.

2. The dressing wheel suitable for dressing a grinding wheel surface of claim 1, further comprising at least one additional dressing wheel component including at least one flat grinding surface adjacent to the interrupted cutting outer surface, said grinding surface being suitable for dressing a grinding wheel.

3. The dressing wheel suitable for dressing a grinding wheel surface of claim 2, wherein the at least one flat grinding surface is selected from the group consisting of diamond, borazon, silicon carbide, silicon nitride, silicon oxynitride, silicon carbonitride, boron carbide, tungsten carbide, titanium carbide, aluminum oxide, aluminum nitride, aluminum carbide, and any combination thereof.

4. The dressing wheel suitable for dressing a grinding wheel surface of claim 1, further comprising at least two additional dressing wheel components including flat grinding surfaces adjacent to, and surrounding, the interrupted cutting outer surface, said grinding surface being suitable for dressing a grinding wheel.

5. The dressing wheel suitable for dressing a grinding wheel surface of claim 4, wherein the at least two flat grinding surfaces are selected from the group consisting of diamond, borazon, silicon carbide, silicon nitride, silicon oxynitride, silicon carbonitride, boron carbide, tungsten carbide, titanium carbide, aluminum oxide, aluminum nitride, aluminum carbide, and any combination thereof.

6. The dressing wheel suitable for dressing a grinding wheel surface of claim 1, wherein the interrupted cutting surface is selected from the group consisting of stainless steel of any grade, cold rolled steel, copper, brass, and combinations thereof.

7. The dressing wheel suitable for dressing a grinding wheel surface of claim 1, further comprising a central orifice therethrough to allow for mounting onto a spindle assembly.

8. A dressing wheel suitable for dressing a grinding wheel surface to be used for maintaining a certain tolerance to assure reliability and quality control of ground parts during the grinding operation, comprising:

a first dressing wheel component including at least one interrupted cutting outer surface, wherein the interrupted cutting surface is embodied in a cutting wheel with a plurality of tips extending outwardly from the outer surface, wherein said plurality of tips contacts the grinding wheel during the dressing operation, thereby alleviating glazing and heat expansion of the grinding wheel while being dressed; and a second dressing wheel component including a flat grinding surface adjacent to the interrupted cutting outer surface, said grinding surface being suitable for dressing a grinding wheel, and wherein the interrupted cutting surface dressing wheel components includes multiple star-shaped components sandwiched between ceramic dressing wheel materials.

9. The dressing wheel suitable for dressing a grinding wheel surface of claim 8, wherein the dressing wheel component is selecting from the group consisting of star-shaped, saw-blade-shaped and circular saw-shaped dressing wheel components.

10. The dressing wheel suitable for dressing a grinding wheel surface of claim 8, further comprising a third dressing wheel component including a second flat grinding surface, wherein said second and third dressing wheel components are adjacent to, and surrounding, the interrupted cutting outer surface.

11. The dressing wheel suitable for dressing a grinding wheel surface of claim 10, wherein the second flat grinding surface is selected from the group consisting of diamond, borazon, silicon carbide, silicon nitride, silicon oxynitride, silicon carbonitride, boron carbide, tungsten carbide, titanium carbide, aluminum oxide, aluminum nitride, aluminum carbide, and any combination thereof.

12. The dressing wheel suitable for dressing a grinding wheel surface of claim 8, wherein the interrupted cutting surface is selected from the group consisting of stainless steel of any grade, cold rolled steel, copper, brass, and combinations thereof.

13. The dressing wheel suitable for dressing a grinding wheel surface of claim 8, wherein the flat grinding surface is selected from the group consisting of diamond, borazon, silicon carbide, silicon nitride, silicon oxynitride, silicon carbonitride, boron carbide, tungsten carbide, titanium carbide, aluminum oxide, aluminum nitride, aluminum carbide, and any combination thereof.

14. The dressing wheel suitable for dressing a grinding wheel surface of claim 8, further comprising a central orifice therethrough to allow for mounting onto a spindle assembly.

15. A dressing wheel suitable for dressing a grinding wheel surface to be used for maintaining a certain tolerance to assure reliability and quality control of ground parts during the grinding operation, comprising:

a dressing wheel component including at least one interrupted cutting outer surface, wherein the interrupted cutting surface is embodied in a cutting wheel with a plurality of tips extending outwardly from the outer surface, wherein said plurality of tips contacts the grinding wheel during the grinding operation, thereby alleviating glazing and heat expansion of the grinding wheel while being dressed; and two dressing stones adjacent to, and surrounding the dressing wheel component, wherein the dressing wheel component is sandwiched between the two ceramic dressing wheel stones.

16. The dressing wheel suitable for dressing a grinding wheel surface of claim 15, wherein the dressing wheel component is selecting from the group consisting of star-shaped, saw-blade-shaped and circular saw-shaped dressing wheel components.

17. The dressing wheel suitable for dressing a grinding wheel surface of claim 15, wherein the interrupted cutting surface is selected from the group consisting of stainless steel of any grade, cold rolled steel, copper, brass, and combinations thereof.

18. The dressing wheel suitable for dressing a grinding wheel surface of claim 15, wherein each of the dressing stones is selected from the group consisting of diamond, borazon, silicon carbide, silicon nitride, silicon oxynitride, silicon carbonitride, boron carbide, tungsten carbide, titanium carbide, aluminum oxide, aluminum nitride, aluminum carbide, and any combination thereof.

19. The dressing wheel suitable for dressing a grinding wheel surface of claim 15, further comprising a central orifice therethrough to allow for mounting onto a spindle assembly.

* * * * *